US008827235B1

(12) United States Patent
Fisher, III

(10) Patent No.: US 8,827,235 B1
(45) Date of Patent: Sep. 9, 2014

(54) CONCRETE FORM FOR BUILDING FOUNDATION CONSTRUCTION WITH FORM INSERT CREATING RECESSED SECTIONS

(76) Inventor: William L. Fisher, III, Nazareth, PA (US)

( * ) Notice: Subject to any disclaimer, the term of this patent is extended or adjusted under 35 U.S.C. 154(b) by 0 days.

(21) Appl. No.: 13/470,053

(22) Filed: May 11, 2012

(51) Int. Cl.
*E04G 11/08* (2006.01)
*E04B 2/84* (2006.01)

(52) U.S. Cl.
CPC .. *E04G 11/08* (2013.01); *E04B 2/84* (2013.01)
USPC ..... 249/35; 52/264

(58) Field of Classification Search
USPC ..... 249/33, 34, 35; 52/250, 262, 264, 52/311.1, 424, 425, 439, 316
See application file for complete search history.

(56) References Cited

U.S. PATENT DOCUMENTS

| | | | | | |
|---|---|---|---|---|---|
| 826,878 | A | * | 7/1906 | Pegram | 249/16 |
| 1,055,237 | A | * | 3/1913 | Shipman | 249/35 |
| 1,472,174 | A | * | 10/1923 | Hughes | 249/35 |
| 2,272,659 | A | * | 2/1942 | Daley | 249/193 |
| 2,381,613 | A | * | 8/1945 | Mitchell | 249/35 |
| 2,658,252 | A | * | 11/1953 | Avril | 249/16 |
| 2,762,105 | A | * | 9/1956 | Avril | 249/20 |
| 3,382,637 | A | * | 5/1968 | Longinotti | 52/320 |
| 3,503,583 | A | * | 3/1970 | Emerson | 249/176 |
| 3,543,458 | A | * | 12/1970 | Guritz | 52/127.3 |
| 3,549,115 | A | * | 12/1970 | Williams | 249/33 |
| 3,689,021 | A | * | 9/1972 | Liester et al. | 249/35 |
| 3,844,522 | A | * | 10/1974 | Cochran | 249/19 |
| 3,885,296 | A | * | 5/1975 | Stout | 29/433 |
| 4,003,542 | A | * | 1/1977 | Beer et al. | 249/31 |
| 4,116,415 | A | * | 9/1978 | Ward | 249/35 |
| 4,145,024 | A | * | 3/1979 | Ward | 249/35 |
| 4,731,971 | A | * | 3/1988 | Terkl | 52/742.14 |
| 4,841,702 | A | * | 6/1989 | Huettemann | 52/309.12 |
| 4,881,714 | A | * | 11/1989 | Koppenberg | 249/60 |
| 4,924,641 | A | * | 5/1990 | Gibbar, Jr. | 52/204.1 |
| 4,942,707 | A | * | 7/1990 | Huettemann | 52/259 |
| 5,074,517 | A | * | 12/1991 | Scott | 249/112 |
| 5,111,628 | A | * | 5/1992 | Desjoyaux et al. | 52/169.7 |
| 5,172,532 | A | * | 12/1992 | Gibbar, Jr. | 52/309.12 |
| 5,219,473 | A | * | 6/1993 | Sandwith | 249/35 |
| 5,397,096 | A | * | 3/1995 | Nelson | 249/31 |
| 5,803,964 | A | | 9/1998 | Scarborough | |
| 6,076,320 | A | | 6/2000 | Butler | |
| 6,119,432 | A | | 9/2000 | Niemann | |
| 6,272,749 | B1 | | 8/2001 | Boeshart et al. | |
| 6,332,599 | B1 | * | 12/2001 | Spartz | 249/34 |
| 6,739,102 | B2 | | 5/2004 | Roy, Sr. | |
| 6,817,150 | B1 | * | 11/2004 | Boeshart | 52/309.6 |
| 7,185,467 | B2 | | 3/2007 | Marty | |
| 7,810,293 | B2 | | 10/2010 | Gibbar et al. | |
| 2008/0184650 | A1 | | 8/2008 | Fischer | |
| 2008/0216445 | A1 | | 9/2008 | Langer | |

* cited by examiner

*Primary Examiner* — Michael Safavi
(74) *Attorney, Agent, or Firm* — Charles A. Wilkinson; Clinton H. Wilkinson

(57) ABSTRACT

A residential or light industrial cast-in-place building foundation system including a form insert made of polymer foam, wood or plastic meant to stand upright within a typical removable concrete form side by side with poured concrete. Once assembled for use, a series of channels and voids are formed on one side of the normally flat removable forms. Each channel is designed to flare toward the outside of the concrete form to transfer energy and pressure through the concrete to be placed within the forms. After the concrete cures and the form panels will be removed, the form insert can be left in place for thermal efficiency or remove and reused on another project.

8 Claims, 6 Drawing Sheets

CONCRETE FORM FOR BUILDING FOUNDATION CONSTRUCTION WITH FORM INSERT CREATING RECESSED SECTIONS

FIELD OF THE INVENTION

The present invention relates to building foundation construction, and more particularly to an engineered foundation wall system and construction method primarily for use in residential and light building construction, and more particularly still to a concrete form insert for use in combination with a conventional form and related components in the formation of cast-in-place foundation walls that require less material and expense to construct than conventional foundation construction systems and methods.

BACKGROUND OF THE INVENTION

Forms or molds are widely used in the construction of cast-in-place concrete building foundation wall slabs. Concrete is preferred as a construction material for several reasons. For one, concrete is economical because the basic constituent materials, cement, sand, aggregate, and water, are usually available locally, so that local sources of both labor and materials can be used in a construction project. Concrete is preferred as a foundation material because of its excellent compression strength; however concrete is also a brittle composite material which has relatively poor tensile strength, so that a tensile stress that exceeds such tensile strength caused by factors such as an applied load, shrinkage, or temperature changes can cause concrete cracking and possible failure. Fortunately, reinforcing materials including steel bars (rebar) and/or other metal wire enforcement or tie materials if formed as part of a concrete slab greatly increase the lateral or tensile strength of the slab, and help absorb and distribute tension due to expansion and contraction of the concrete. As a result, if provided with waterproofing and other proper protection from climatic and environmental elements, building foundations made of reinforced concrete are sturdy and long-lasting.

Use of forms to mold concrete perimeter foundation walls into desired structural shapes is prescriptive in most construction code books. Concrete forms are conventionally built on-site out of pairs of plywood sheets which are aligned in a spaced-apart opposing relationship and are supported by wood beams or other support means so as to define cavities or voids in which the concrete foundation is poured. Various prefabricated form systems made of alternative materials such as steel, aluminum, and plastic are also available, which systems may be modular and include their own support or bracket systems. Once the concrete has been poured, which is usually preceded by the placement of a reinforcing steel material in the form cavity, and has completely set up, conventional forms are removed, leaving a foundation wall in the desired shape having essentially smooth outer and inner surfaces. In some newer systems, however, the formwork stays in place after the concrete has set up, either to provide additional reinforcement or some other purpose such as acting as an insulating barrier. It is also known to place other components in a concrete form before the concrete is poured, such as pipe inserts to create apertures for conduit passing through the wall, and liners for insulation purposes or to provide an architectural textured surface on the finished wall.

One shortcoming of conventional poured concrete residential wall construction is that it is not an inexpensive process which requires substantial quantities of construction materials as well as significant on-site skilled labor to excavate and ready the site for building, erecting the forms, pouring the concrete and allowing for curing, removing the forms, and other operations, all of which add time and expense to a building project. Conventional residential construction also typically requires a footer or footing to be formed under the foundation to transmit the load from the walls into the underlying soil. Typical residential homes require a sixteen or twenty inch wide footer that is six to sixteen inches in depth, although this it will be understood can vary depending upon the size and type of home construction, the bearing capacity of the soil, and local building codes. Preparing for, pouring, and allowing the footer to cure sufficiently before a foundation wall is poured adds several days and significant cost to a residential home construction. In addition, since concrete is permeable to water, a water-proof coating usually must be applied to the wall. Concrete foundation walls should also be insulated to prevent loss of heat through the wall to the soil or open air by conduction.

It is desirable therefore to reduce the overall construction time, labor, and cost of residential and light construction. Many attempts to lower construction costs are related to replacing on-site labor with generally less expensive factory labor and precast or prefabricated systems. However, prefabricated buildings have their own costs including transportation costs. The following references are exemplary of existing alternative wall and floor building and foundation construction applications and systems.

U.S. Pat. No. 5,803,964 issued to Scarborough discloses the use of an expanded polymeric foam such as expanded polystyrene (EPS) in building construction applications including formation of structural sections and building foundations. The Scarborough system preferably forms complete concrete structures made of EPS, which material is covered by a layer of sprayed concrete that binds to the EPS. Additional concrete or rod reinforcing is provided where required, and the outer surface is sealed by a sprayed polymer resin.

U.S. Pat. No. 6,076,320 issued to Butler discloses a method of constructing a cast-in-place perimeter wall foundation comprised of corrugated steel panels in which the bottom edges of the panels are cast in a concrete footing. In one embodiment the Butler system is finished on the exterior by applying rigid foam panels to the steel structure and then stuccoing over the foam. The Butler foundation system is designed for modular construction applications such as mobile homes.

U.S. Pat. No. 6,119,432 issued to Niemann discloses a cast-in-place foundation system in which foam panels are used as forms to create channels for the poured concrete, and which foam panels are left in place after the concrete cures to form a composite structure. The Niemann panels are not reusable, and the system requires additional parging on the exterior panel as a finish.

U.S. Pat. No. 6,272,749 issued to Boeshart et al. discloses a form system for insulated concrete decks. The Boeshart system is a horizontal application in which concrete is poured on top of a plurality of interconnected expanded polystyrene form panels having a channel cut on the opposite side from the concrete receiving surface in which an insert having engaged structural members is housed. Thus, the Boeshart et al. system is not used to form cast-in-place vertical walls, and using the decks as wall panels would comprise a precast wall system requiring heavy equipment to move and set the panels.

U.S. Pat. No. 6,739,102 issued to Roy, Sr. discloses a cast-in-place trench foundation wall wherein the forms used to create a cavity to hold poured concrete are made of extruded foam insulation, preferably extruded polystyrene, and are backfilled against on both sides. The panels are maintained in place after the poured concrete has hardened. Roy, Sr. does not provide a form insert and does not alter the conventional concrete foundation wall. In addition, this invention is not meant for unbalanced fill situations which are found in crawlspaces and basements exterior surface, still requires a finish above grade such as a stucco finish.

U.S. Pat. No. 6,817,150 issued to Boeshart discloses another horizontal roof and floor deck system which is similar to the Boeshart et al. '749 patent but additionally comprises a means for increasing the thickness of the polystyrene panels such that the slots filled with concrete between the panels are thicker. As in the '749 patent, the system is poured horizontal not vertical would require heavy equipment to move and place the walls if they were used for a wall application.

U.S. Pat. No. 7,185,467 issued Marty teaches an integral insulative foam and concrete panel cast-in-place forming system designed to replace and act as post and beam construction just using concrete instead of wood and steel. Marty therefore is not a foundation system but a slab on grade construction technique.

U.S. Pat. No. 7,810,293 issued to Gibbar et al. discloses a precast as opposed to a cast-in-place foundation system that is poured flat and requires heavy equipment to move and place the forms.

U.S. Patent Application Publication US2008/0184650 filed by Fischer discloses a form of insulated concrete block in which a foam layer is provided on the inside and outside face but also includes a foam middle layer, which blocks are stacked one on top of another and side by side to create a wall, after which the blocks are filled with concrete. A stucco coating is then applied as an exterior finish.

U.S. Patent Application Publication 2008/0216445 filed by Langer utilizes a decorative finishing product such as drywall, brick, decorative stone, and ceramic tile on the interior and exterior of a wall to take the place of a form, whereby concrete is poured into the void between the products to form either precast or cast-in-place structures so that all the products are bound together. The Langer system is a monolithic building assembly more suited for above ground applications and multi-story building, and requires special products that can be exposed to uncured concrete to create the interior and exterior assemblies.

While these other building systems and methods are presumably suited for their particular intended purposes, there remains a need in the construction industry for a cast-in-place foundation wall construction that is particularly useful in constructing residential, light commercial, and light industrial buildings, that significantly reduces the amount of on-site labor, time, and expense of a building project, and where the resulting foundation wall is strong enough to bear both the compressive and lateral loads typically imposed on concrete walls in such building structures and applications. Prior art walls that attempt to replicate similar advantages are primarily precast walls which are formed flat within a mold and after the concrete cures require heavy equipment including tractor trailers for shipping to the construction site and/or cranes to lift the walls into place. While reducing material, this technique requires a large expense to move and set the walls. Other cast-in-place systems use flat sheets of foam on both sides of the concrete as forms.

BRIEF SUMMARY OF THE INVENTION

The present invention is a cast-in-place foundation wall system and construction process that modifies standard construction techniques and utilizes an innovative form insert which optimizes already popular foundation forming methods. Each form insert has a generally rectangular main body section and includes one or more depressed sections, which depressed sections when the insert is placed in a use position against the inner wall panel of a conventional concrete form project from the inwardly facing surface of the insert towards the outer wall form panel. A plurality of said form inserts are similarly positioned against the inner wall of the form so as to adjoining and such that the depressed sections are horizontally and vertically aligned, forming a series of laterally and longitudinally extending channels between the depressed sections on the same and adjoining inserts, in which channels reinforcing steel bars are positioned to increase the load bearing strength of the wall. Concrete is then poured into the form cavity, filling the channels and surrounding the reinforcing material, while the depressed sections cause voids to be formed in the inner surface of the resulting foundation wall between the channels. Each of the depressed sections has an outer surface in the shape of a parallelogram, which outer surface is in parallel with the main body section of the insert. Each depressed section is also defined by angled surfaces which extend between the inner surface of the main body of the insert and the depressed section outer surface, preferably at a forty-five degree angle with respect to the insert main body. The angled sections transfer load pressure applied laterally to the wall from the outside and redirect or transfer such pressure to the thicker reinforced channel sections. Use of the form inserts of the present invention reduces the amount of concrete required in a typical poured foundation wall while maintaining the strength of the wall due to the combined configuration of the depressed sections and reinforced channel sections. Once the wall has cured and the forms are removed, the insert can also be removed and reused, or if the insert is comprised of an insulative material it may be left in place against the inner surface of the cured concrete wall to provide insulation for the wall. Thus, the present invention also permits the option of utilizing a removable reusable insert or an insulated interior insert that remains over the finished wall surface. In another improvement, a foundation system formed using the construction process of the invention in one embodiment does not require a separate concrete footer to support the structure, and removes the need for exterior perimeter drains since the stone foundation will act like a large drywell and allow water to exit via a tail drain or sump pump, and also eliminates the need for an expansion strip. Overall, therefore a significant time and cost savings is achieved in the construction process of the present invention.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following detailed description is of the preferred embodiment(s) of the invention presently contemplated. Such description is not intended to be understood in a limiting sense, but to be merely exemplary in nature and presented solely for illustration thereof, and by reference to which in connection with the following description and the accompanying drawings one skilled in the art may be advised of the advantages and construction of the invention.

The purpose of the present invention is to provide a cast-in-place foundation wall system and construction process that reduces the amount of time and material required to build a structure foundation, and as a result to construct a building structure. As part of the system, a plurality of form inserts or insert members are positioned in the space defined by a conventional form system used to receive a settable mass such as concrete, which inserts create a plurality of recessed areas or cavities spaced along the inner surface of the foundation wall. Reinforcing material such as steel bars are positioned in the channels created between the recessed areas or cavities to provide adequate strength to the finished wall.

Figure 1:
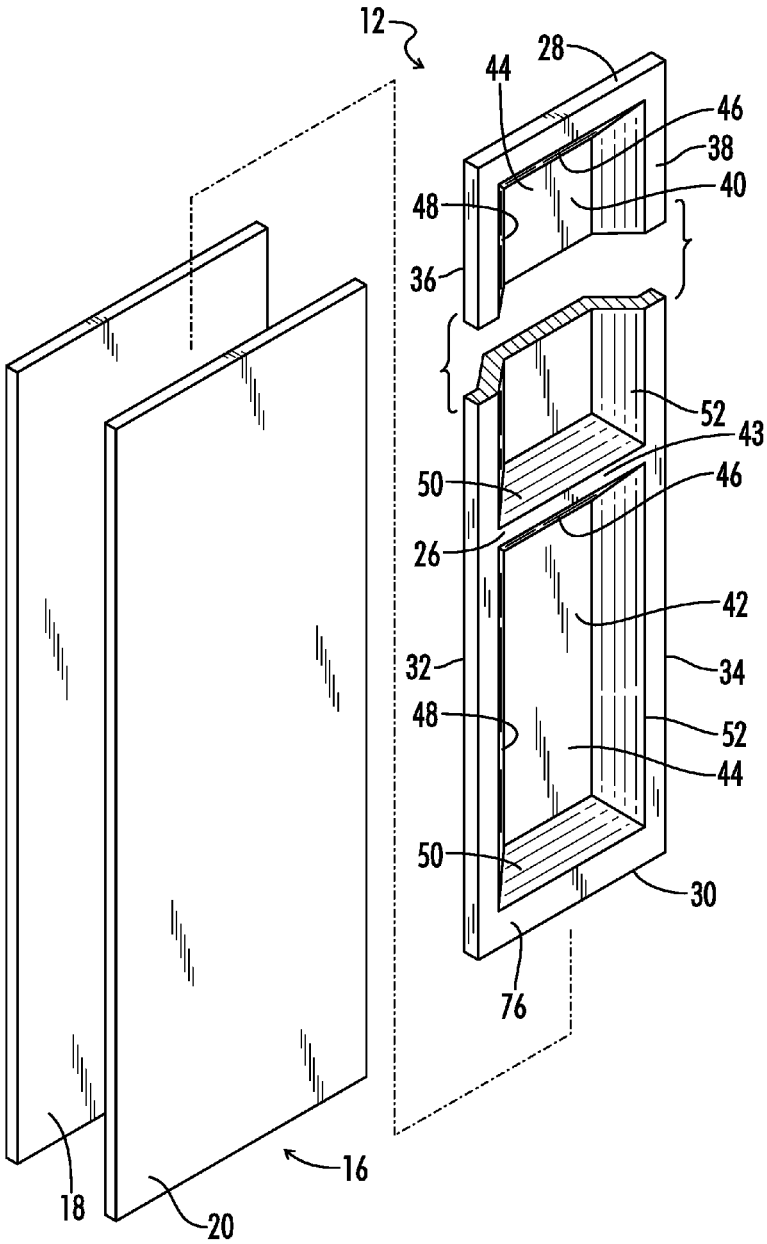
FIG. 1 is a perspective view of one side a form insert in accordance with the foundation wall system and construction process of the present invention in close proximity to a concrete form section.
Figure 2:
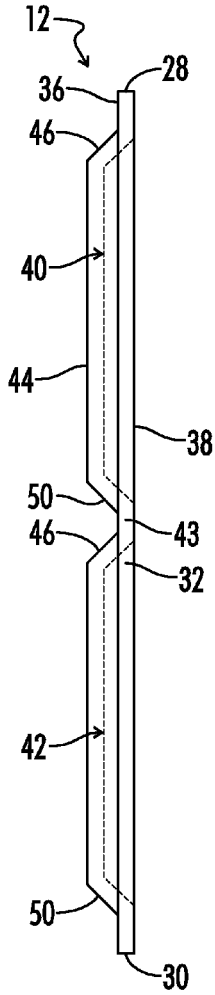
FIG. 2 is a side view of the form insert shown in FIG. 1.
Figure 3:
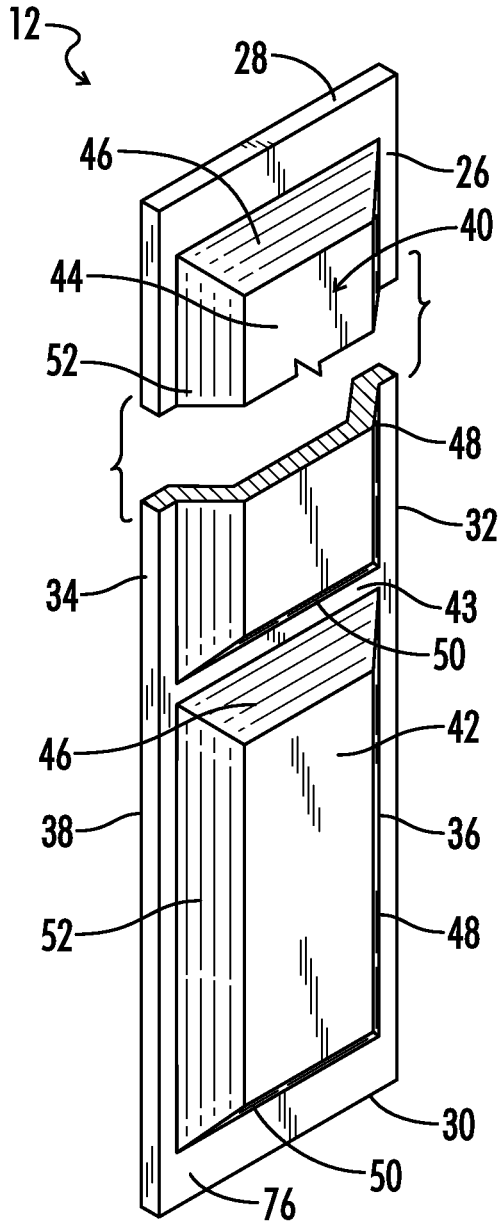
FIG. 3 is a perspective view of the opposite side of the form insert shown in FIGS. 1-2.
Figure 4:
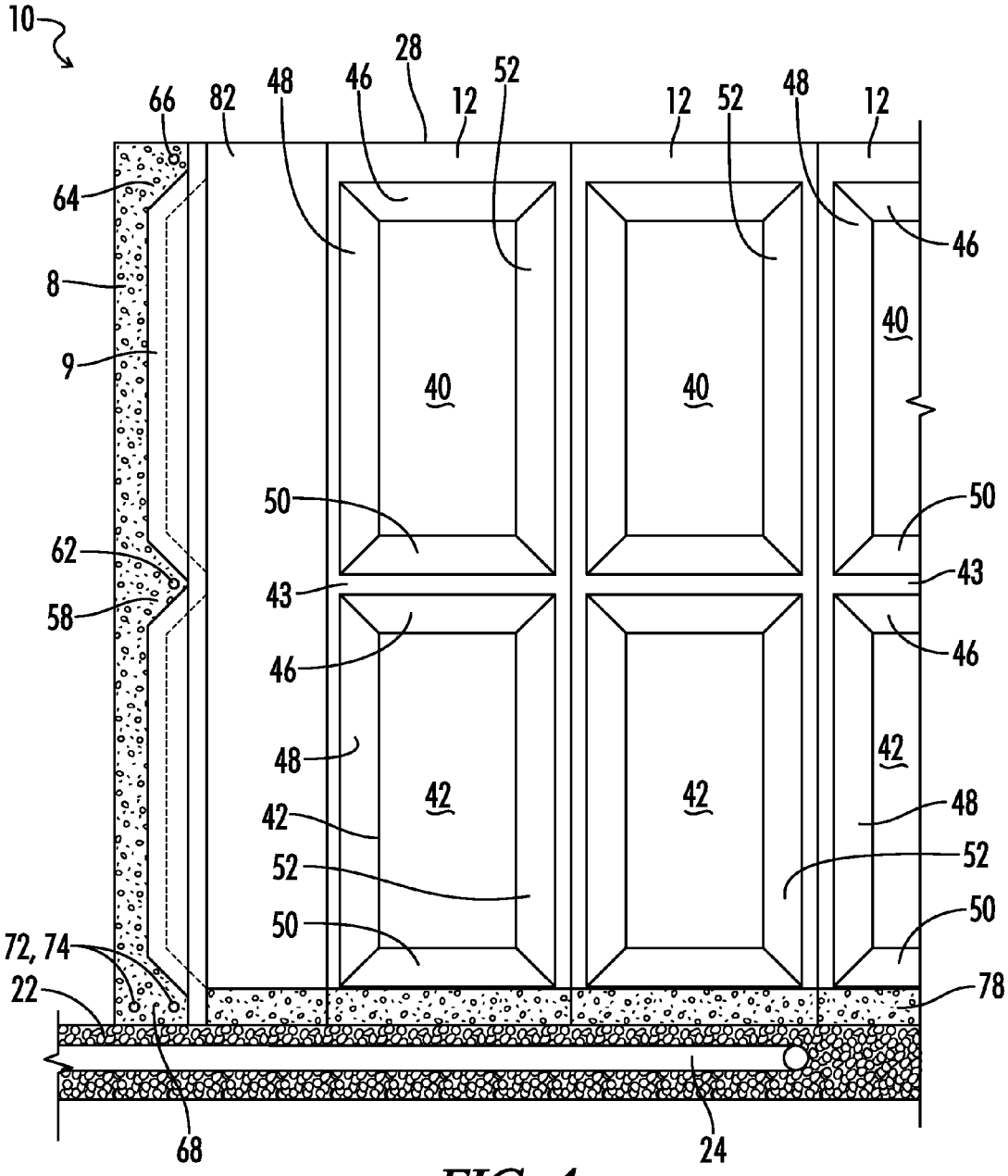
FIG. 4 is an interior elevation and partial sectional view of a foundation wall manufactured in accordance with the present invention with the form inserts applied to the inner wall surface.
Figure 5:
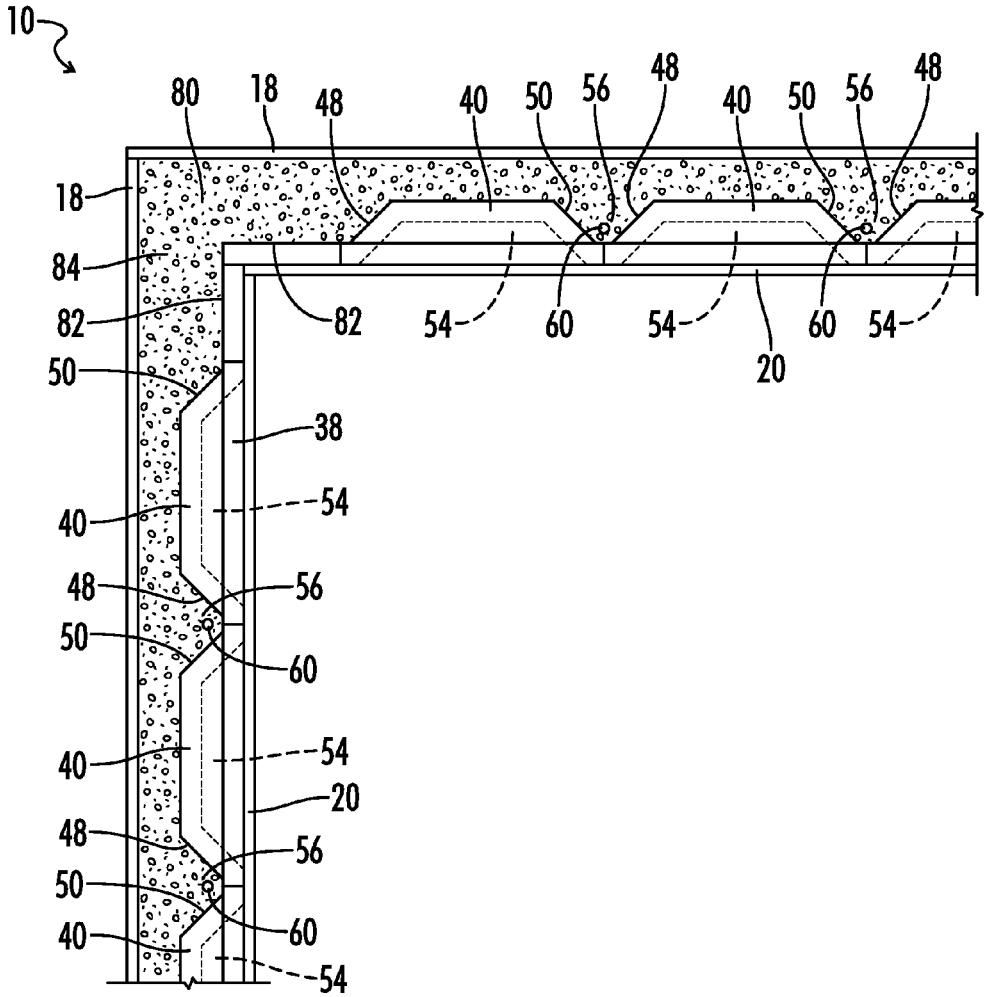
FIG. 5 is an elevation sectional view from the top of a foundation wall corner formed in accordance with the foundation wall system and construction process of the present invention.
Figure 6:
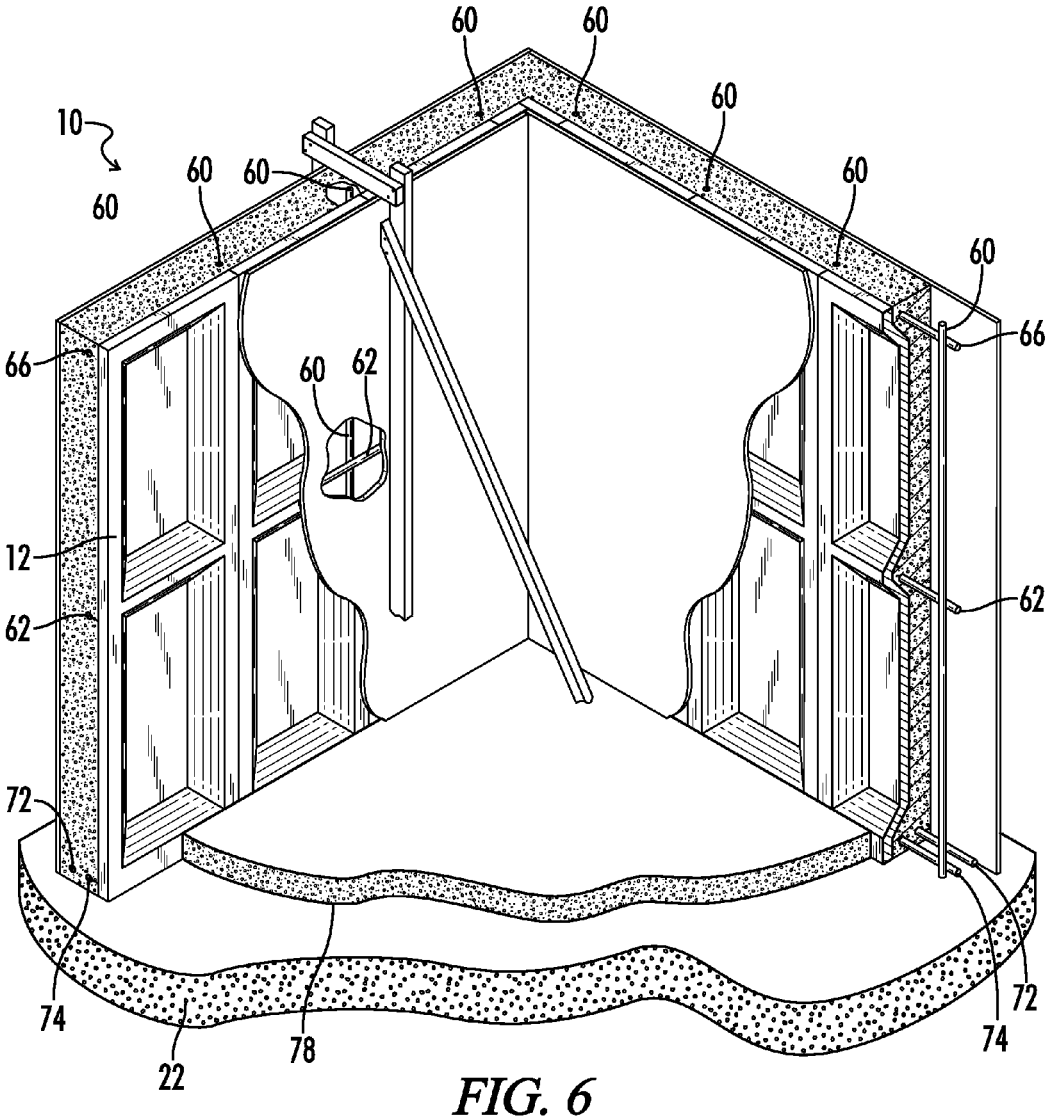
FIG. 6 is partially broken away perspective view of a foundation wall section constructed in accordance with the system and process of the present invention.

Referring now to the drawings, wherein like reference characters designate identical or corresponding parts throughout the several views, FIGS. 1-3 illustrate a preferred embodiment of a form insert 12 used in forming an engineered cast-in-place concrete foundation wall 10 in accordance with the present invention, while FIGS. 4-7 illustrate a preferred embodiment of such foundation wall 10. Referring in particular now to FIGS. 1-3, concrete form insert 12 is adapted to be used in combination with an existing concrete form or forming system, an example of which is also illustrated in FIG. 1 by form section 16 which is comprised of spaced-apart opposing outer and inner panels 18 and 20. It will be understood by those skilled in the art that in FIG. 1 form section 16 represents only a small section of a foundation wall form, and that a plurality of panels 18 and 20 of the forming system each of which are typically identical in construction to each other except where variations are required will be utilized and assembled by suitable hardware or bracing means in the appropriate layout or pattern so as to define an upright cavity such as shown in FIG. 5 for receiving poured concrete in a position where a cast-in-place foundation wall structure is to be built. In the typical implementation illustrated generally in FIG. 4, after the foundation area for a residential or small commercial building is excavated, a layer of fine stone 22 approximately eight to twelve inches thick is laid over the soil or ground surface, making sure that suitable interior drains 24 have been placed or provided within the stone layer to ensure proper drainage from underneath the foundation. As best shown in FIG. 6, form system 16 is then assembled and positioned directly on top of the stone bed 22 without requiring, for reasons discussed in greater detail below, a separate footing to be poured, although it will be understood that the foundation wall system of the present invention may be utilized with a standard type foundation footing as desired. Once the forms 16 have been erected and secured in a desired position, inserts 12 are then positioned along against the inside face of inner form panel 20 (see FIGS. 5 and 6). Reinforcing rebar or other metal reinforcement is then strategically positioned in the spaces or columns defined between the inserts or insert sections, after which concrete is poured and sets to form the finished engineering wall structure.

Referring again to FIGS. 1-3, insert 12 has a rectangular frame or body 26 which includes parallel and spaced apart top and bottom members 28 and 30, first and second opposing longitudinal members 32 and 34 which extend perpendicularly between top and bottom members 28 and 30, a first side surface 36 which when insert 12 is placed in form 16 faces towards the outer wall panel 18, and a second side surface 38 which when insert 12 is placed in form 16 is abutting against inner wall panel 20. In addition, recessed sections 40 and 42 are provided in body 26 of each insert 12, and project outwardly from first side surface 36. Recessed section 40 is positioned between from top member 28 and opposing longitudinal members 32 and 34; similarly, recessed section 42 is positioned between bottom member 30 and opposing longitudinal members 32 and 34. In addition, recessed sections 40 and 42 are spaced apart by cross-member 43. Recessed sections 40 and 42 are preferably similarly sized and vertically aligned on body 26 of inserts 12, although this could vary depending on the specific requirements of the foundation wall. Recessed sections 40 and 42 each have a center section 44 which is preferably flat and in the shape of a parallelogram, and as shown in the Figures may be rectangular in shape. Each center section 44 is surrounded on its sides by angled sections 46, 48, 50 and 52 which connect between the surface 36 of body 26 and center section 44. More particularly, angled sections 46, 48, 50 and 52 are positioned at a tapered incline or angle of about forty-five degrees with respect to the longitudinal axis of insert 12, which angle as will become evident ensures that the finished foundation wall has sufficient structural rigidity.

As best shown in FIG. 4-6, in forming a cast-in-place foundation wall 10 in accordance with the present invention, a plurality of inserts 12 are juxtaposed in a vertical side-by-side or adjoining relationship in the space defined by form section 16, with second side surface 38 of body 26 of the inserts 12 pressed against the interior surface of inner form panels 20, with the lower edge of bottom members 30 in contact with the underlying stone layer 22, and longitudinal members 32 and 34 of adjoining inserts 12 in abutting contact. Although not required, longitudinal members 32 and 34 of inserts 12 may include a means for securing adjoining members 32 and 34 together, such as a male/female or tongue/groove arrangement, and may also include an alignment aid means. In addition to the volume or space taken up by the inserts 12 when placed in the spaced defined by form 16, as best shown in FIG. 5 a void 54 is created in form 16 in the space between recessed sections 40 and 42 and inner panels 20 of form 16, due to the manner in which recessed sections 40 and 42 project forwardly or outwardly from first side surface 36 of body 26 of each insert 12. It will be understood by those skilled in the art that while voids 54 are shown in the Figures, in another embodiment inserts 12 could be constructed such that second side surface 38 of inserts 12 is uniform or flat as shown at 84 in FIG. 7. However, voids 54 are preferred particularly where the inserts 12 are to be removed after the foundation wall has been formed and reused as they can be more easily stacked and transported with recessed sections 40 and 42 in a nesting relationship.

When inserts 12 are positioned side-by-side in form section 16 with their second side surfaces 38 against the interior wall of inner panel 20, as best shown in FIG. 5, vertical channels 56 are created by the spaced relation or gaps between adjacent recessed sections 40 and 42 on the aligned inserts 12. More particularly, channels 56 are centered along the vertical juncture between the side edges of opposed longitudinal members 32 and 34 in each pair of adjacent inserts 12, and between angled sections 48 and 52 of adjacent recessed sections 40 and 42. In addition, as shown in FIG. 4, a horizontal channel or center cord 58 is formed extending horizontally between each of the spaced apart recessed sections 40 and 42 on the aligned inserts 12. More particularly, center cord 58 is formed by the spaced relation or gaps between recessed sections 40 and 42 on each insert, which includes cross-members 43, lower angled sections 50 of recessed sections 40, and upper angled sections 46 of recessed sections 42. Center cord 58 also connects between vertical channels 56 which further strengthens the resulting foundation wall. In a preferred embodiment, a gap of about 1½ to 3 inches exists between side-by-side angled sections 52 and 48 of recessed sections 40 and 42 on adjacent inserts 12, and between angled section 50 of recessed section 40 and angled section 46 of recessed section 42 on each insert 12.

In addition, as shown in FIG. 4, a horizontal top chord 64 is formed above recessed sections 40 of the inserts 12, extending between the upper edge of top members 28 of inserts 12 and top angled sections 46 of recessed sections 40. Top chord 64 also connects the upper ends of stud channels 56 together, and further provides a surface to support and attach a sill plate for the structure to be supported on the foundation wall in a manner that is well known to those skilled in art. Similarly, a bottom chord 68 is formed extending between the lower edge of bottom members 30 of inserts 12, angled sections 50 of each of recessed sections 42, and stone layer 22 or other intermediate support surface.

To further strengthen foundation wall 10, a reinforcing rebar or steel rod 60 is positioned in each of the vertical channels 56 extending substantially the length of the channels. A reinforcing rebar 62 is also preferably positioned extending horizontally in horizontal channel or center cord 58 to add tensile strength to the center chord of the poured concrete wall to resist backfill pressure. In addition, a reinforcing rebar 66 is placed horizontally extending substantially the length of top chord 64 to add tensile strength to the top chord. Two horizontally aligned reinforcing rebars 72 and 74 are also placed extending horizontally in bottom chord 68, which provides the bottom chord 68 with sufficient tensile strength so that the need for a footer to be poured underneath foundation wall 10 is eliminated. The required size of rebar 60, 62, 66, 72 and 74 is dependent upon soil conditions and type and calculated load. Under normal conditions, it has been found that one-half inch steel rods are suitable. Reinforced vertical channels 56 and horizontal channel 58 as well as top and bottom horizontal channels or cords 64 and 68 in combination with the structure of recessed sections 40 and 42 form a reinforced grid-like foundation wall structure 10.

In a preferred arrangement, the material of insert 12 including body 26 and recessed sections 40 and 42 has a thickness of about two inches. In addition, angled sections 48 and 52 connect with longitudinal members 32 and 34 at a position spaced inwardly from the side edges of longitudinal members 32 and 34 a minimum of about 0.75 inches. Thus, when longitudinal members 32 and 34 of adjacent inserts 12 are juxtaposed with their side edges in abutment, the combined width of adjoining longitudinal members 32-34 is at least about 1.5 inches, ensuring columns 56 have a similar width. The outer surface of center section 44 of recessed sections 40 and 42 is spaced about four inches from surface 36 of body section 26 of insert 12, and angled sections 46, 48, 50 and 52 join between body section 26 and center section 44 at about a forty-five degree angle with respect to surface 36. This arrangement results in the columns 56 formed between adjacent recessed sections having sufficient dimensions to receive and immerse the reinforcing rebar material, and that the resulting foundation wall 10 will have sufficient lateral strength. When used on a conventional eight foot basement wall, center section 44 of recessed sections 40 and 42 preferably has dimensions of about 14 inches across by 34 inches high, although as already indicated the size and dimensions of inserts 12 can be varied according to particular construction requirements and conditions. Angled section 50 connects with base section 76 at a position spaced inwardly from the bottom edge 30 of insert 12 at least about four inches, giving base section 76 of body 26 a width of about four inches and as illustrated in FIGS. 4 and 6 allows a concrete floor slab 78 to be poured on top of stone layer 22 to a conventional thickness of four inches up to angled sections 50. This also eliminates the need for an expansion strip to be provided when the floor slab 78 is poured against foundation wall 10.

As illustrated in FIG. 5, corner sections 80 are also provided for by the present invention, as spacing material 82 will be utilized in a manner that will be familiar to those skilled in the art to fill in at such corners, as well as below any foundation wall beam pockets, not shown, where full depth concrete walls are required. A settable mass such as concrete 84 is thus poured into and fills the form cavity, surrounding rebars 60, 62, 64, 66, 72, and 74 but does not fill voids 54 or the space taken up in the form cavity by inserts 12.

Foundation walls formed using the foundation system of the present heights will typically have several different heights based on the application. Examples are eight foot walls for a typical basement, nine foot walls for a slightly higher basement and four foot walls for crawlspaces and garages. Where standard 2'×8' concrete forms, such as Symons Form, are used they should be placed on top of the stone, the inserts placed on the inside face of the form and rebar inserted into the forms as required. Once the concrete is poured and cured, the forms are removed, and the inserts may be left in place or removed and reused. When crawlspace areas (about 4' high walls) are being formed, the forms and inserts which are designed for an eight foot high wall may be turned on their sides. While the inserts shown in the drawings figures are shown as designed for use in connection with such standard 2' by 8' forms and therefore have similar dimensions, it will be understood that the inserts can have different dimensions such as being provided in 2' by 4' sections for a foundation wall without having a basement, or other customized dimensions such as larger 4' by 8' sections as may be dictated by the particular foundation wall requirements for a particular building load.

In addition, it will be understood that inserts having different numbers of rows of recessed sections dimensions may be utilized in the same foundation wall project while still falling within the intended scope of the present invention. Furthermore, the number and dimensions of the recessed sections may also be varied from the illustrated embodiment, with the limitation that the angled sections of the recessed areas are aligned with the reinforced channels or cords so that the bearing load of the wall is directed to such reinforced channels or cords by the recessed areas so as to provide a foundation wall capable of residential-scale bearing and shear loadings. It will also therefore be understood that the foundation wall system is not limited to use in connection with walls of particular dimensions, including the wall height, thickness of the walls, thickness of the reinforcing steel, psi of the concrete utilized, and the particular dimensions of the form inserts utilized in accordance with the invention. It has been determined upon designing the foundation wall system that by locating the reinforcing bars in the channels and cords as described above the finished wall has very satisfactory strength and serviceability requirements, that are both proportioned to resist factored load effects and satisfy requirements for deflection and cracking.

Provision of inserts 12 in a concrete form or form section 16 significantly reduces the amount of concrete required to construct a foundation wall of any size.

Recessed sections 40 and 42 of inserts 12 which project inwardly from body 26 of the inserts 12 on angled sections 46, 48, 50, and 52, create cords or channels 56, 58, 64, and 68 into which the poured concrete will flow and cure. The channels 56 in combination with the reinforcing rebar 58 give the foundation wall the required compressive strength to support the live and dead loads that may be applied on the foundation by the building structure and use thereof. Angled wall sections 46, 48, 50 and 52 which are preferably at about a forty-five degree angle with respect to body section 26 of inserts, transfer pressure applied to the wall from the side on such sections to the vertical and horizontal channels for strength. The forty-five degree angles of angled walls or side sections 46, 48, 50, and 52 of recessed sections 40 and 42 also allow the panels to be stacked one on top of the other in a nested relationship for easy transport to job sites and storage. It will also be understood that positioning the channels along the inside face or surface of the poured concrete wall is best suited to help the finished foundation wall withstand the bending force caused by the backfill dirt. The maximum tensile bending force or lateral stress caused by a backfill load pressing against the foundation wall occurs on the inner fibers of the concrete wall, while the maximum compressive bending stress occurs on the outer face or surface of the wall. Thus, the stress or bending load caused by the backfill dirt against the wall is offset by providing the reinforcing rebar along the inner surface of the wall which arrests propagation of any cracks since the tensile strength of the rebar is much greater than that of the concrete.

In one embodiment, inserts 12 are comprised of any material that is capable of withstanding the loads exerted on the inserts when standing in an upright position against the inner panel 20 of a typical removable concrete form side by side with concrete poured in the form cavity, such as a molded polymer foam material, wood or plastic. In a preferred embodiment, inserts 12 are made of an insulative foam material such that after the forms 16 are removed, inserts 12 can be maintained on the wall permanently. When the form inserts are made of foam and left in place, the need to insulate the foundation separately is eliminated, and the foundation wall meets EPA Energy Star criteria and International Residential Construction Code insulation values for many areas of the United States. Alternatively, the foam inserts can be removed from the inner foundation wall surface when the wall has cured, and reused in another job.

Where inserts 12 are formed of an insulative foam material, such material may be an extruded polystyrene (EPS), expanded polystyrene (XPS), or other rigid material having desired insulative properties. As an example, use of the inserts of the invention when forming a conventional foundation wall having a thickness of eight inches, it has been found that a foam insert having a thickness of about two inches provides satisfactory results. In addition, the recessed sections also have a thickness of about two inches, and the flat surfaces of the recessed sections 40 are spaced about two inches from the insert body section, so that the flat sections are spaced about four inches from the inner surface of inner form panel wall.

Use of the concrete foundation wall forming process of the present invention results in a considerable reduction in the amount of concrete required to construct a typical foundation wall, ranging from about 30% to about 35% depending on the particular application. In another conventional application, ready-mix concrete preferably at least 3500 psi is utilized and poured into the forms, and is allowed to set and cure, creating the foundation walls. Bolts or other hold-down anchors are typically then embedded in the top of the finished wall as the concrete is setting up such that they extend from the top of the foundation, and are later used as hold-down anchors to anchor the building structure to be built on top of the foundation to the foundation walls. Once the poured concrete foundation wall sets up, the form is removed, at which point a top or sill plate is usually secured to the top of the concrete foundation wall by the anchors that were embedded in the top of the wall. The inserts may also then be removed from the inner wall surface, and can be stored or readied for use in a next job. Alternatively, if the form inserts are made of an insulating foam material, they can be left on the wall permanently to provide thermal insulation. It will also be understood that in another embodiment, where the inserts are reusable, the inserts can be provided integrally with the inner panel 20 of the form system, with the inserts being either attachable to said inner panels with the pattern of the inner surface of the inserts formed integrally on the interior surface of the inner panels.

Figure 7:
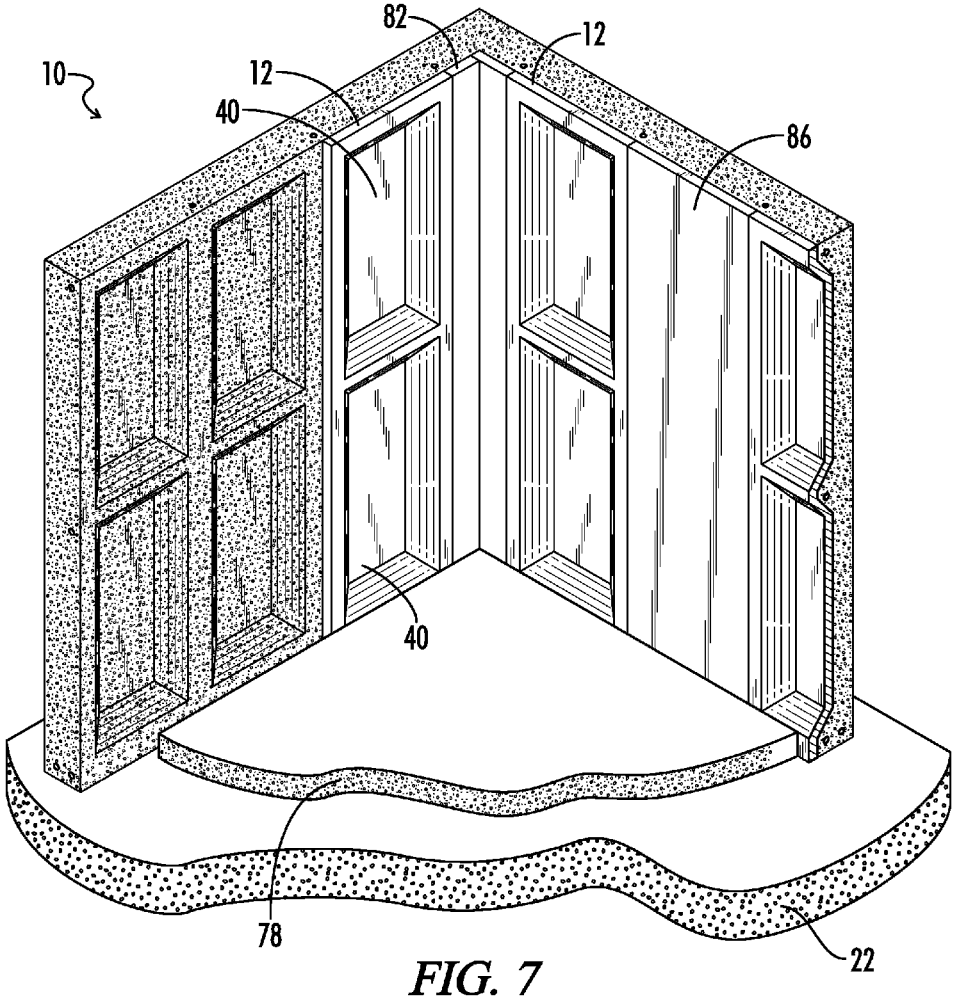
FIG. 7 is a perspective view of a finished foundation wall section formed in accordance with the system and process of the present invention.

As indicated above and illustrated in FIGS. 4 and 6, formation of a foundation wall 10 in accordance with the teachings of a preferred embodiment of the present invention eliminates the need for pouring a separate foundation footer. Rather, provision of two spaced apart reinforced bars 72-74 in lower horizontal cord or channel 68 provides the finished wall with more than adequate strength and rigidity to support and distribute that live and dead loads to be applied by the building constructed on the foundation, while the design of the foundation wall further aids in distributing or redistributing such weight to the large surface area of lower cord or channel 68 to prevent sinking. It will be understood that in some applications such as where the base of a foundation wall formed in accordance with the present invention is above the freeze line, or where required by code, a separate footer may be utilized. FIG. 7 illustrates a finished foundation wall section 10 in accordance with the present invention both with inserts 12 removed from part of the finished wall, and remaining over a section of the finished wall. An alternative insert 86 having a smooth inner surface is also shown, although it will be understood that depressed sections 40 and 42 are still present on the inner side of inserts 12 and are still formed in foundation wall 12.

The advantages of the present foundation system therefore include:

- Reduced cost of construction;
- Reduction of the amount of concrete required to pour due to cavities or recessed areas formed in the wall;
- Reduced time in the construction process of between 3 to 5 days;
- Elimination of the need for a footer;
- Elimination of the need to insulate the basement or crawl space later since the inserts can be formed of an insulating material and left on the wall;

Reusability of form inserts;

Use a bed of stone to support the wall which allows the use of less foundation drains, saving time and money since the stone will act like a large drywell and allow water to exit via a tail drain or sump pump.

Site built foundation wall does not require heavy equipment to build foundation such as in precast wall systems.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A building foundation system, comprising:

at least inner and outer elongated form panels each having an inwardly facing side surface which surfaces are arranged in an opposing spaced apart relationship to define an upright cavity having an outer and inner periphery;

at least one form insert, said insert including a body section having a top edge and a bottom edge defining a longitudinal axis, first and second side edges extending perpendicularly between said top and bottom edges, a first side surface, and a second opposite side surface including at least one outwardly projecting recessed section, said at least one recessed section having an outer surface with a parallelogram shape and being in parallel with the longitudinal axis of the body section, and a plurality of side sections extending between the second side surface of said body section and said outer surface at an acute angle;

said at least one form insert designed to be placed in said upright cavity with the first side surface abutting against the inwardly facing side surface of the inner elongated form panel, further defining a settable mass receiving area between the second side surface of the at least one form insert and the inwardly facing side surface of the outer elongated form panel in which a foundation wall having an outer surface defined by the inwardly facing side surface of the outer elongated form panel and an inner surface defined by the second side surface of the at least one form insert is formed, said settable mass receiving area including a plurality of horizontal and vertical channels either between adjacent recessed sections in the at least one form insert or around the periphery of said at least one recessed section of the at least one form insert; and a reinforcing material disposed in at least some of said horizontal and vertical channels.

2. The foundation system of claim 1 in which the at least one form inserts includes at least two recessed sections spaced apart at regular intervals forming said channels between said recessed sections.

3. The foundation system of claim 2 in which said at least two recessed sections are in horizontal and vertical alignment with each other, and in which the angled side sections of said at least two recessed sections are aligned horizontally and vertically.

4. The foundation system of claim 2 in which a vertical channel is defined between the recessed sections of at least two aligned insert panels, and first, second and third horizontal channels are defined extending along the top, bottom, and between at least one pair of vertically aligned recessed sections, respectively.

5. The foundation system of claim 4 additionally comprising two reinforcing bars provided in the second horizontal channel forming an integral footer-like member.

6. The foundation system of claim 5 in which a recessed section is spaced at least about four inches from the bottom edge of each insert panel, forming a base section having a sufficient width to accommodate a poured foundation floor.

7. The foundation system of claim 1 in which said acute angle is about a forty-five degree angle.

8. The foundation system of claim 1 in which the at least one form insert is formed integrally as part of the inwardly facing side surface of the inner elongated form panel.

* * * * *